United States Patent [19]

Warner et al.

[11] 3,967,659

[45] July 6, 1976

[54] CONTAINER FILLING APPARATUS

[75] Inventors: Graeme W. Warner, Hinsdale; Victor M. Svagdis, Palos Park; James W. Petrzelka, Cicero; John C. Nalbach, LaGrange Park, all of Ill.

[73] Assignee: John R. Nalbach Engineering Company, Inc., Chicago, Ill.

[22] Filed: May 16, 1975

[21] Appl. No.: 578,278

[52] U.S. Cl. ..... 141/79; 141/148; 141/374

[51] Int. Cl.[2] ..... B65B 1/22

[58] Field of Search ..... 141/129–191, 141/250–284, 374, 71–80

[56] References Cited

UNITED STATES PATENTS

| | | | |
|---|---|---|---|
| 1,073,067 | 9/1913 | Ayars | 141/146 |
| 2,185,201 | 1/1940 | Kraus et al. | 141/146 |
| 2,711,849 | 6/1955 | Gale | 141/146 |

*Primary Examiner*—Houston S. Bell, Jr.
*Attorney, Agent, or Firm*—Anthony S. Zummer

[57] ABSTRACT

The subject matter contained herein is an apparatus for filling like containers with a given amount of divided matter. The apparatus includes a housing, with a drive mounted in the housing. A filling turret is positioned in the housing; and the filling turret has a rotatable portion connected to the drive, to be rotated thereby. The filling turret includes a filling tank, having a rotatable base connected to and rotated by said drive at a selected rate. A plurality of measuring flasks is arranged in a circle, having its center concentric with the axis of rotation of the rotatable portion of the filling turret. The measuring flasks are connected to the rotatable base of the filling tank for receiving divided matter from the filling tank and measuring the amount of said divided matter. A container pocket is positioned adjacent to each of the measuring flasks and moves with the rotatable base of the filling tank. A straight-line input conveyor delivers a plurality of open-ended empty containers to the container pockets. The co-action of the rotation of the container pockets with the input conveyor positions an open-ended empty container in each of the pockets as each of the pockets passes the input conveyor. A container elevator lifts each of the empty containers into telescoping relationship with its respective measuring flask; and carries each container, in cooperation with the rotating container pocket, to an arcuate container support. The containers are held on the arcuate support while they are filled with the divided matter; and are then delivered to an output conveyor. The output conveyor has a straight-line path tangential to the circular path of the container pockets to carry away the containers filled with divided matter.

20 Claims, 11 Drawing Figures

Fig. 3
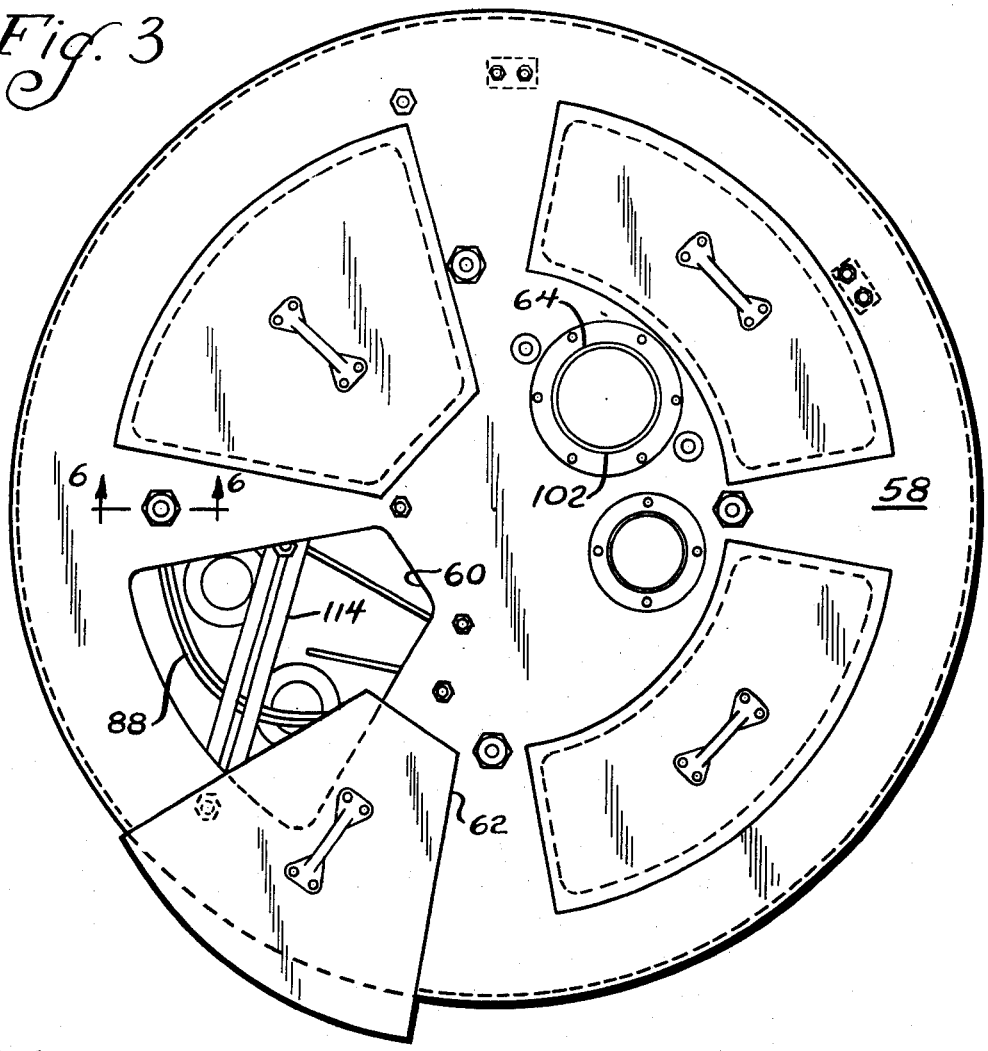
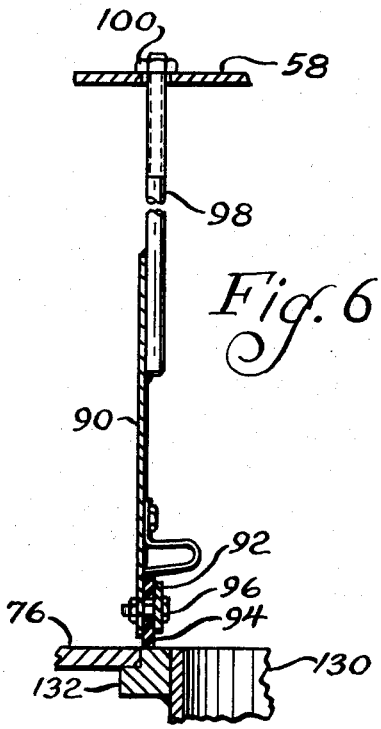
Fig. 6
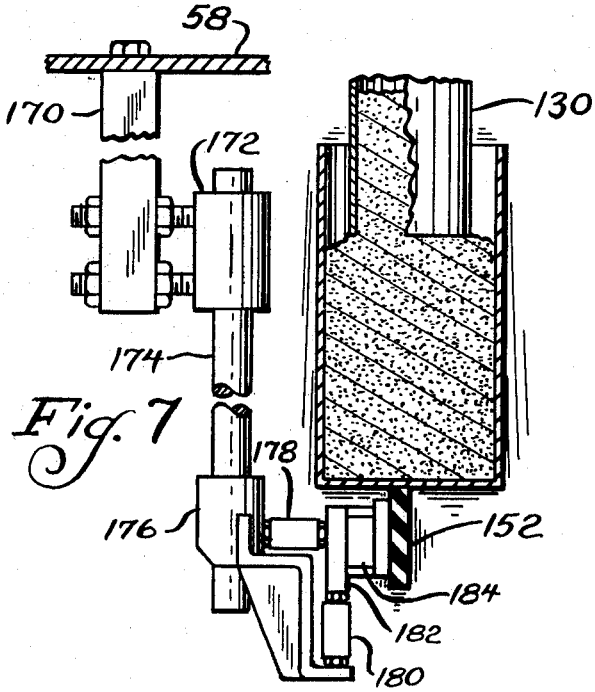
Fig. 7

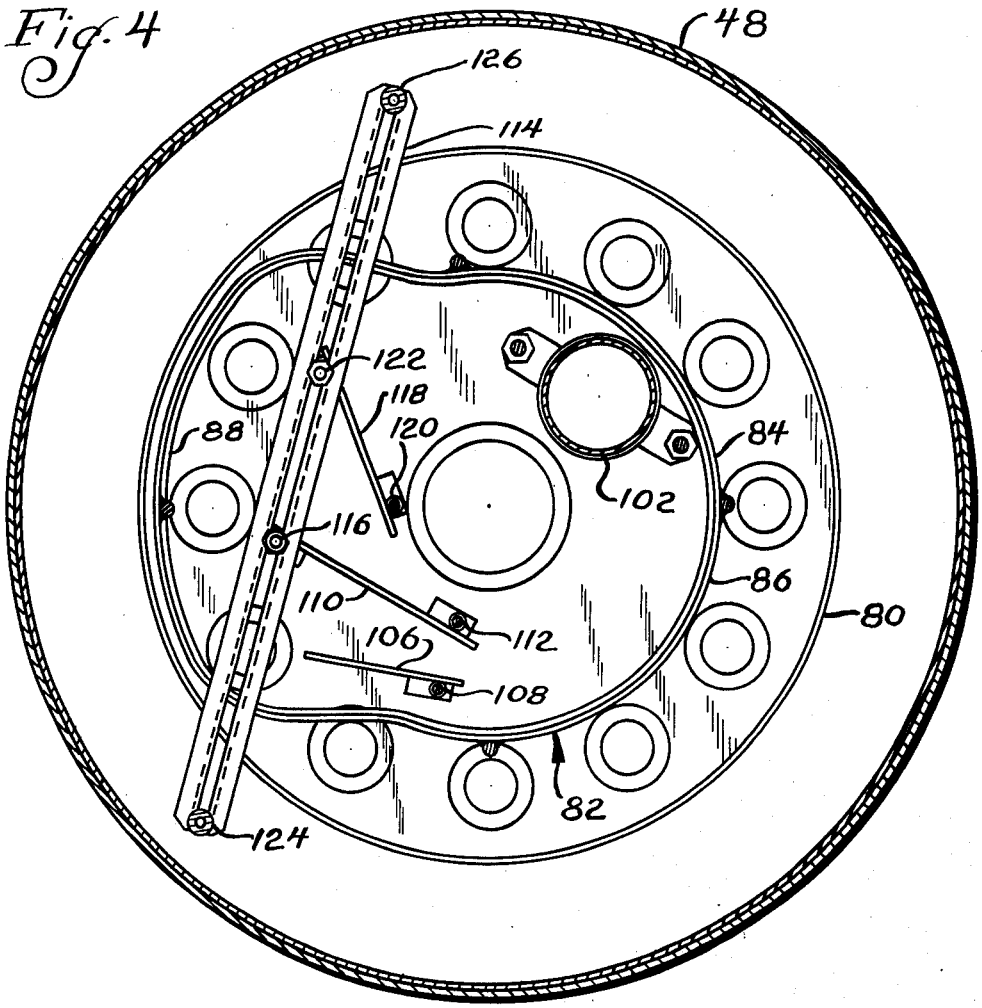
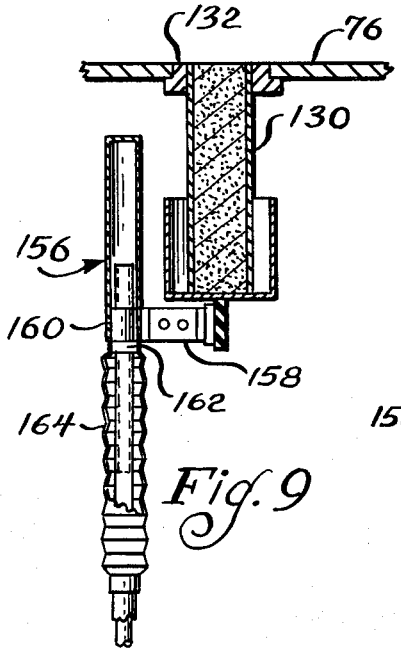
Fig. 9
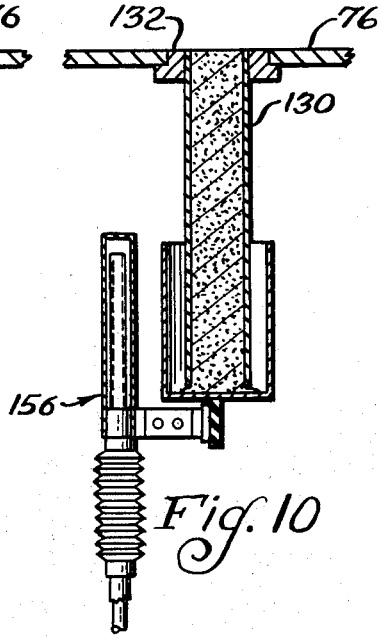
Fig. 10
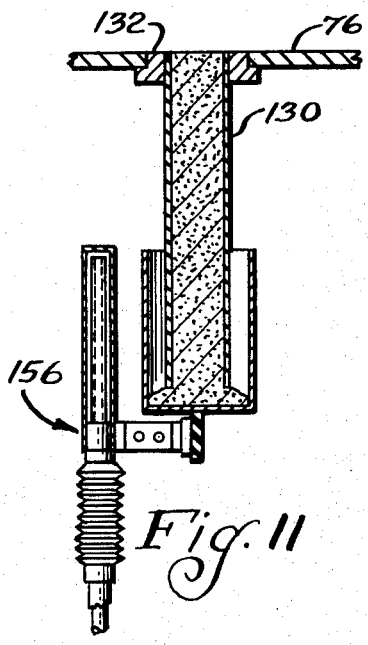
Fig. 11

CONTAINER FILLING APPARATUS

BACKGROUND OF THE INVENTION

Apparatus for filling open-ended containers with free-flowing powdered or granular material is well-known. These powdered or granular materials include a broad range of food products, including milk products, condiments, tea, coffee, sugar, salt, cocoa, rice and seeds, as well as a general chemical line, including cleansers, detergents, insecticides, drain and bowl cleaners, lyes, crystals, and the like. An apparatus of this general type is disclosed in U.S. Pat. No. 2,849,033, issued Aug. 26, 1958, to John R. Nalbach. Apparatus of this type has found a wide range of acceptance in the food industry, chemical industry, and cosmetic industry, for packaging all manner of dry material in powdered or granular form. In the course of the operation of the prior art apparatus, several problems with the apparatus have been observed. The prior art device utilizes a pair of starwheels in the operation of the apparatus. The starwheels operate in a satisfactory manner. However, there is a problem in the exact synchronization of the starwheel, which requires a highly-skilled mechanic; also, a problem of removal of filled containers from the machine. The more product in the container, the more likely it is to spill as the direction of movement of the container is changed sharply.

Another problem which occurs in the operation of any mechanical apparatus is that there is no absolute perfection. Oftentimes, containers may be slightly bent, or for some reason are not fed into the apparatus, so that a measuring flask filled with a powdered or granular material discharges its entire contents, not into a container, but into the machine. This requires the machine to be halted for cleaning purposes and, if there is a prolonged absence of containers, the machine has to be shut down completely for a thorough cleaning.

In order for the measuring flasks to operate properly, it is necessary for the material to be of the same density since the flasks operate on a volumetric principle. The head of the material which is to be filled determines the density. It is particularly desirable to have the same head in a filling tank, thus eliminating any variations in the quantity of material which is delivered into the containers.

SUMMARY OF THE INVENTION

The present invention relates to an improved construction for an apparatus used in filling like containers with a like measured amount of powdered or granulated material. The apparatus includes a housing, with a drive mounted in the lower portion of the housing. A filling turret, having a rotatable portion, is mounted in the housing. The rotatable portion is driven by said drive. The filling turret includes a filling tank, which includes a rotatable base which rotates with the filling turret. A plurality of measuring flasks is connected to the rotatable base of the filling tank for receiving matter from the tank and measuring the amount of material received. Said measuring flasks are arranged in a vertical attitude in a circle, having its center concentric with the center of the circle of rotation of the rotatable portion of the filling turret. The material is dispensed from each of the measuring flasks into its respective container.

A container pocket positioned adjacent to each of the measuring flasks revolves with its respective flask for carrying a container positioned in the pocket. A straight-line input conveyor is positioned in a horizontal attitude, with one end entering the housing for delivering empty containers in a straight-line path toward the filling turret. The straight-line path of the input conveyor intersects the circular path of the container pockets at a point where the velocity of a container pocket at the point of intersection includes a vector at a right angle to the direction of movement of the input conveyor for seating securely the empty conveyor in the container pocket.

The container pocket carries the empty container to a container elevator, which elevator raises the empty container into a telescoping relationship with its respective measuring flask so that the container provides a bottom for the measuring flask. The container is carried to an arcuate container support, which is parallel to the path of movement of the container. A measured amount of material is delivered to the empty container from its respective measuring flask. The arcuate container support includes a downwardly-sloping portion, so that the container is gradually moved down relative to its respective measuring flask to allow the material in the flask to be deposited in the flask. The container is thereby filled with material. The container is carried along the arcuate container support by its respective container pocket to a point where the container leaves the arcuate support and is deposited onto an output conveyor.

The output conveyor has a straight-line path, which path is tangential to the circular path of the container pockets. The output conveyor is parallel to the input conveyor; and is immediately adjacent thereto. Accordingly, the instant apparatus provides a means for filling empty containers with a powdered or granular material and delivering the filled containers to a straight-line conveyor with a minimum of opportunity for the container to tip or spill. It is therefore a principal object of the present invention to provide an improved apparatus for filling like containers, which apparatus delivers filled containers in an attitude for easy handling of the filled containers.

It is another object of the present invention to provide an improved container-filled apparatus, which apparatus has parallel and adjacent input and output conveyors.

It is a still further object of the herein-disclosed invention to provide an apparatus for filling like containers, in which containers are automatically and surely introduced into the apparatus.

It is still another object of this invention to provide an improved container-filling apparatus, in which granular or powdered material is uniformly delivered to the containers in a prescribed amount.

It is still another object of this invention to provide a container-filled apparatus, in which spilled material is picked up in the apparatus and discharged therefrom.

Other objects and uses of the present invention will become readily apparent to those skilled in the art upon a perusal of the following specification in light of the accompanying drawings.

DESCRIPTION OF THE DRAWINGS

FIG. 3 is a top view of the filling apparatus shown in FIG. 1, showing a cover partially removed in order to show better the interrelationship of certain parts in a filling tank;

FIG. 4 is a cross-sectional view taken on line 4—4 of FIG. 2, showing a portion of a filling tank;

FIG. 6 is an enlarged cross-sectional view taken on Line 6—6 of FIG. 3, showing a portion of a retainer of the filling tank;

FIG. 7 is an enlarged cross-sectional view taken on Line 7—7 of FIG. 3, showing a portion of an arcuate container support, with a container on the support and in telescoping relationship with a measuring flask, which said container is partially filled with divided matter;

FIG. 9 is an enlarged cross-sectional view, showing a relatively short container positioned on the container support, with a short measuring flask;

FIG. 10 is similar to FIG. 9, showing a larger container positioned adjacent to a larger measuring flask; and FIG. 11 is similar to FIG. 10, showing a container similar to the container shown in FIG. 10, but showing the container spaced a greater distance from the bottom of the measuring flask to allow additional material to be delivered to the container.

DESCRIPTION OF THE PREFERRED EMBODIMENT

Figure 1:
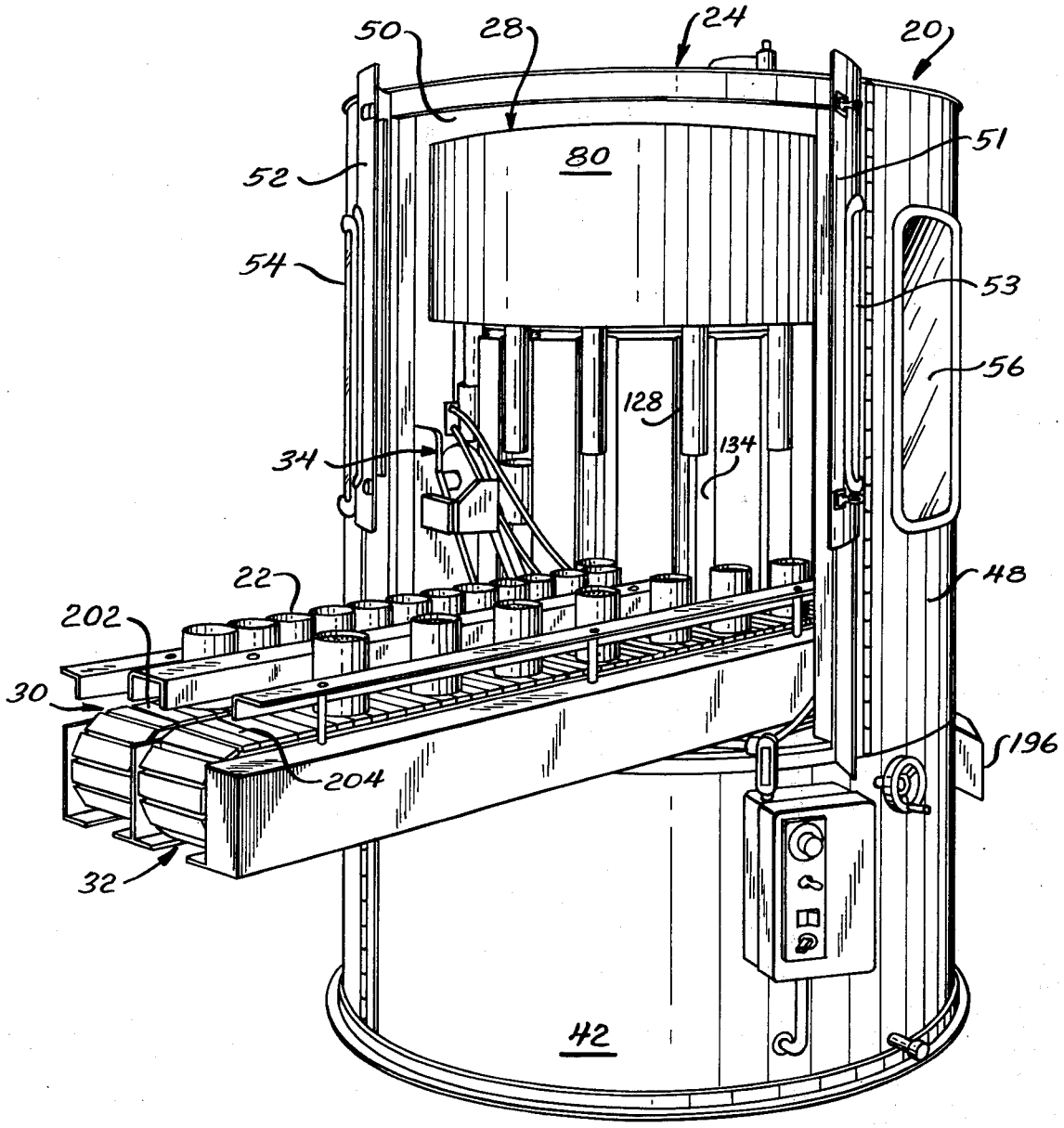
FIG. 1 is a perspective view of a container-filling apparatus embodying the herein-disclosed invention.

Referring now to the drawings, and especially to FIG. 1, a container-filling apparatus generally indicated by numeral 20 is shown therein. A plurality of containers 22 is shown entering a filling station, and leaving the filling station. The apparatus 20 generally consists of a housing 24, with a conventional variable drive 26 mounted in the housing. A filling turret 28 is mounted in the upper portion of the housing; and is drivingly connected to the drive 26. An input conveyor 30 delivers a plurality of empty containers to the filling turret; and an output conveyor 32 carries away filled containers. A container elevator 34 is mounted in housing 20 for raising empty containers to a container support 36. A spillage-recovery assembly 38 is positioned in the housing for recovery of spilled material.

Figure 2:
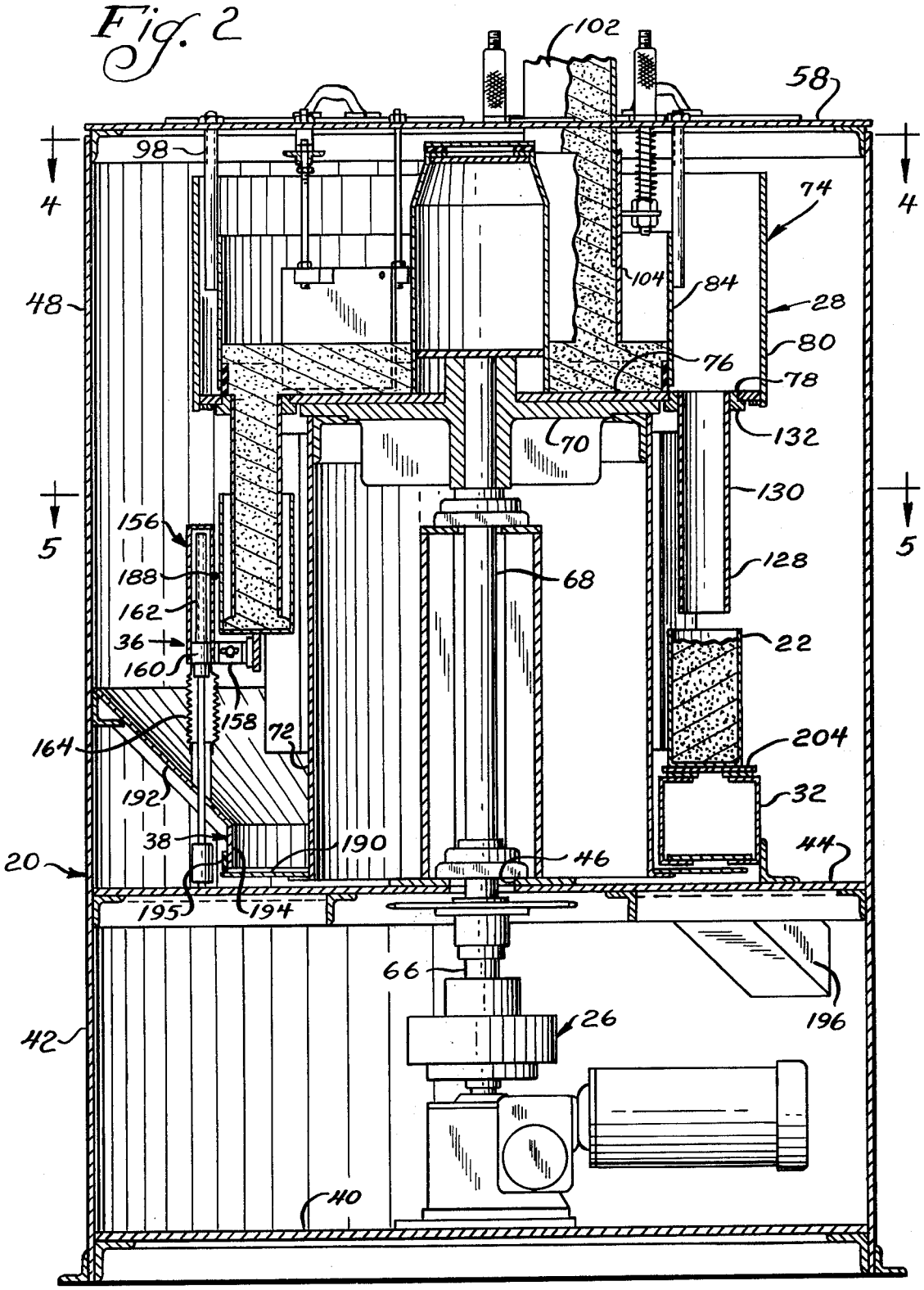
FIG. 2 is a cross-sectional view of the apparatus shown in FIG. 1, showing the interrelationship of the parts of the apparatus.

As may be best seen in FIGS. 1 and 2, a housing 20 generally includes a support 40, upon which is mounted the drive 26. A skirt 42 has its lower edge connected to the support 40 for enclosing the drive 26. A filler floor 44 is mounted on the upper portion of the skirt. The filler floor includes a drive aperture 46 in the center thereof for rotatably receiving a portion of the drive 26. A filler wall 48 is connected to the skirt 42 to form a continuous exterior housing. The filler wall 48 includes an opening 50, which has hingedly mounted therein a pair of doors 51 and 52, with windows 53 and 54 mounted in each of the respective doors. The filler wall 48 also has a plurality of windows 56 to allow an operator to observe the interior of the housing; and thereby observe the operation of the apparatus for malfunctions. The housing also includes a roof 58, which has a plurality of observation and adjustment apertures 60, which are closed by conventional removable covers 62. The roof has an inlet aperture 64 to provide a means for delivering powdered or granular material to the interior of the housing.

The drive 26 is a conventional and well-known electric motor-speed reducer combination, with an output shaft 66 which extends through the aperture 46.

The filling turret 28 includes a drive shaft 68, which is connected to the drive shaft 66. The drive shaft 68 is drivingly connected to a drive hub 70, which has a drum 72 mounted on its outer periphery. A filling tank assembly 74 is mounted on the upper portion of hub 70. The filling tank assembly includes a tank floor or rotatable base 76, with a plurality of flask apertures 78 contained therein. The flask apertures 78 are arranged in a circle about the center of the floor 76, which center of the floor is concentric with the axis of rotation of the tank floor. The tank includes a side wall 80, which is fixed to the outer periphery of floor 76. A retainer 82 is mounted within the side wall 80; and is positioned in sliding engagement with floor 76. The retainer includes a continuous wall 84, which has a central loop 86 and a filler loop 88. The retainer wall 84 includes a sheet metal upper wall 90, with a resilient scraper assembly 92 connected to the lower edge of the sheet metal upper wall 90. The scraper assembly includes a scraper blade 94 secured to wall 90 by a plurality of fasteners 96. The blade 94 is in scraping engagement with the floor 76 to retain a material within the retainer. Continuous wall 84 is suspended from roof 58 by a plurality of rods 98, which are held in place by conventional nuts 100.

An inlet tube 102 is positioned in inlet aperture 64 and terminates below the upper level of the retainer 82. The upper end of tube 102 is connected to a source of material, which is not shown. A telescoping inlet sleeve 104 is movably mounted on the inlet tube 102, so that the inlet sleeve may be adjusted vertically relative to the tube 102 and the floor 76 to regulate the depth of material contained within the retainer.

The filling tank also includes a product guide mounted within the tank. The product guide includes an outer vane 106, which is supported from the roof 58 by a conventional rod 108. An adjustable center vane 110 is supported from the roof by a rod 112 at one end. The other end of vane 110 is supported on an adjustment bar 114 by fastener assembly 116, which allows the vane to be swung into a selected position for directed material in the filling tank. An inner vane 118 has one end pivotedly connected to the roof through a vane rod 120. The other end of vane 118 is connected to the adjustment bar 114 by a second fastener assembly 122. The adjustment bar is also fixed to the roof by fasteners 124 and 126.

The filling turret includes a plurality of verticallyarranged measuring flasks 128, all of which flasks are identical in construction. The measuring flasks each contain an elongated right-circular cylindrical tube 130. Each tube 130 is secured to its respective mounting head 132, which head is fixed in its respective aperture 78. The mounting head and tube are flush with the top of floor 76, for reasons which will become apparent hereinafter.

Figure 5:
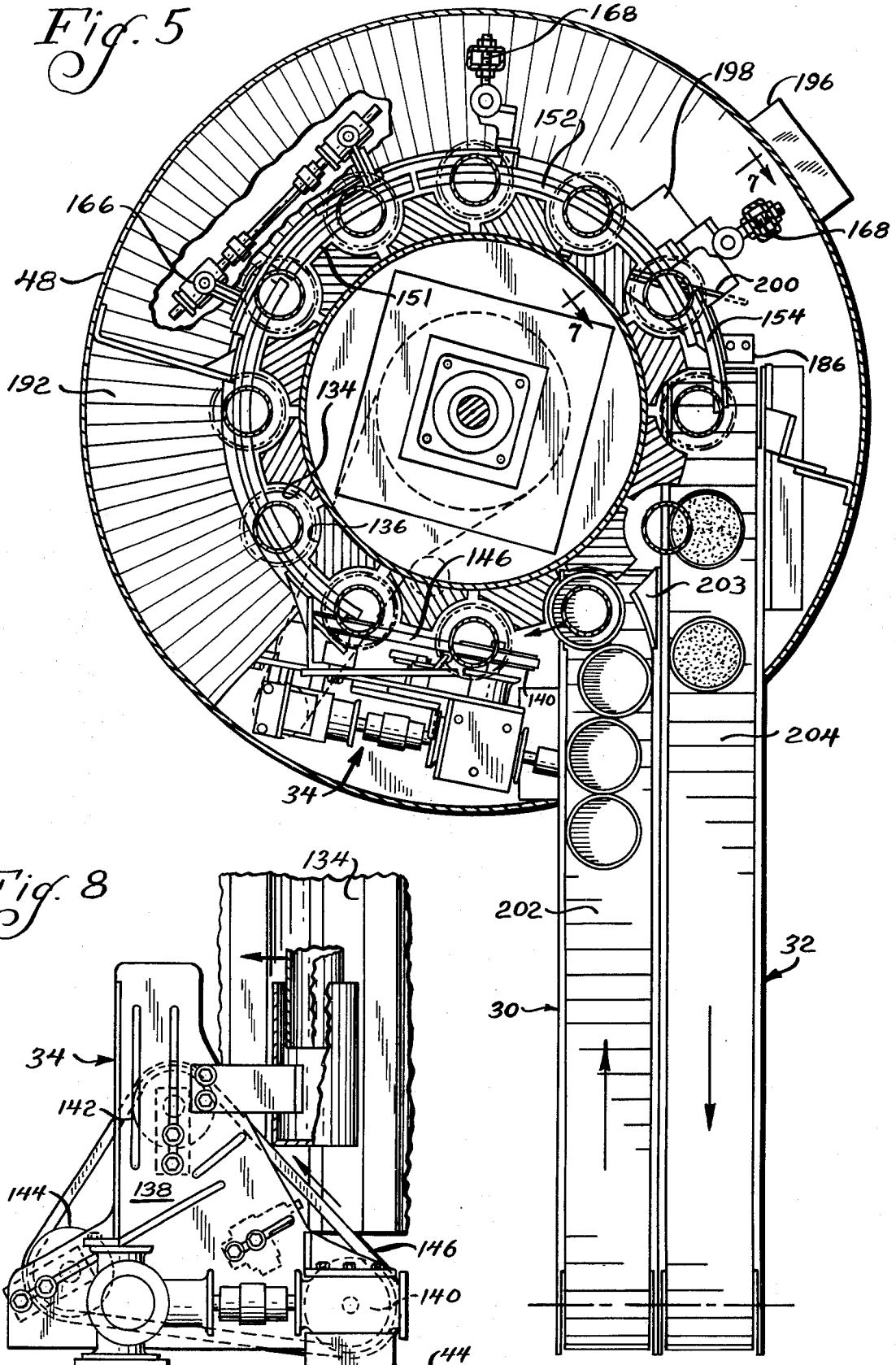
FIG. 5 is a cross-sectional view taken on line 5—5 of FIG. 2, showing a portion of a filling turret, with a plurality of container pockets and the interrelationship of an input and output conveyor relative to the filling turret.
Figure 8:
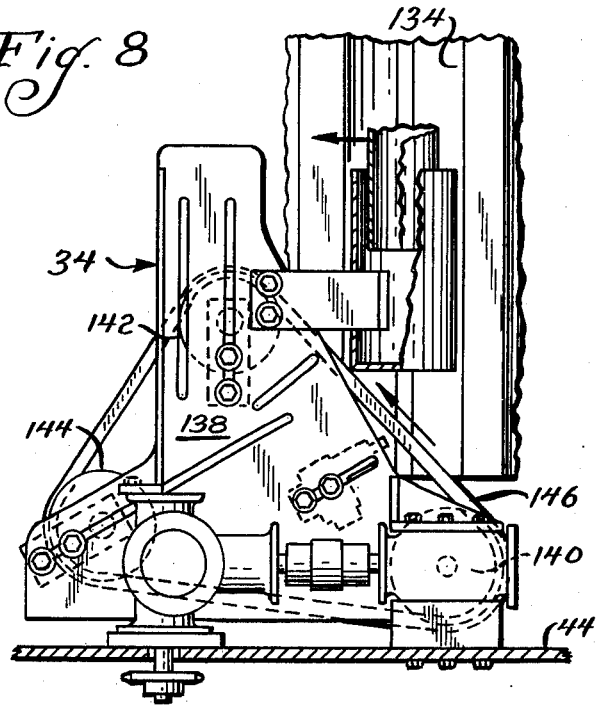
FIG. 8 is an enlarged side elevational view, showing a portion of a container elevator.

As may be clearly seen in FIG. 5, the filling turret includes a plurality of container pockets 134. Each of the container pockets is formed by pocket walls 136, adapted to receive a container. The container pockets are aligned with the respective measuring flasks 128, so that a container positioned in a pocket may be raised and lowered in the pocket and telescopically receive the respective measuring flask. The walls of the pocket are mounted on the drum 72, to be carried with the drum and tank floor as the tank floor rotates under the roof, while the retainer 82 and vanes 106, 110 and 118 remain fixed.

The container elevator 34 is mounted in the housing, adjacent to the input conveyor, for raising empty containers from the level of the input conveyor up to the uppermost level of the container support. The container elevator generally includes a mounting plate 138, which is secured to the floor 44. The elevator includes a fixed drive sheave 140, and a pair of adjustable sheaves 142 and 144, all rotatably mounted on plate 138. The sheaves 142 and 144 may be moved on plate 138 in order to adjust the height of the elevator. A conventional endless belt 146 is conventionally mounted on drive sheave 140, and adjustable sheaves 142 and 144, to provide the carrying surface for the container elevator.

Container support 36 is supported on floor 44 of the housing. The container support includes a sectioned arcuate rail 148, which is generally parallel to the path of the circular path of the measuring flasks. The arcuate rail 148 includes, a rail section 150, a flask-filling section rail 151, a container-filling section rail 152, and a discharge section rail 154. The height of the flask-filling section rail 151 is adjustable, for reasons which will become apparent hereinafter, as well as the introductory portion of the container-filling section rail 152.

The flask-filling section rail 151 is supported by adjustable rail vertical supports 156. Each of the vertical supports includes a rail arm 158, secured to rail 150. The rail arm is, in turn, connected to a support head 160, which is internally threaded and threadedly receives a support column 162. The threaded head and threaded portion of the support column are covered by a boot assembly 164. The rail vertical supports are connected to a support drive assembly 166 to allow the supports to be adjusted simultaneously. Drive assembly 166 is supported on the housing.

The container-filling section rail 152 is supported by identical vibrator assemblies 168. The vibrator assemblies are suspended from roof 58. Each vibrator assembly includes a vibrator rod 170, having its upper end fixed to roof 58. Rod 170 has a collar 172 fixed thereto, with an upright 174 fixed to the collar. The upright includes a bracket 176 fixed to the lower end therein. A horizontal support 178 and a vertical support 180 are mounted on bracket 176. The supports 178 and 180 are connected to a contact bar 182, which is fixed to section rail 152 by a connector arm 184. The discharge section rail 154 is secured to floor 44 by a bracket 186.

A continuous side band 188 is mounted outside of the pockets. The side band is supported by the adjustable vertical supports. The side band is made of an elastic material, so that it may accommodate itself to various size containers.

The spillage-recovery assembly 38 includes a spill floor 190, which is annular and fixed to drum 72. A generally conical dish well 192 is fixed to the interior of filler wall 48. The dish wall slopes inward and downward, as may be seen in FIG. 2. A lower side wall 194 is fixed to the interior of dish wall 192. The side wall terminates adjacent to the spill floor 190. A floor side wall 195 is secured to side wall 194 adjacent to the outer peripheral of floor 190. A chute 196 is positioned in the housing adjacent to the discharge section rail 154. The chute 196 includes an aperture 198. A scraper 200 is mounted in the housing, in scraping engagement with the spill floor 190. The scraper is positioned across the floor to divert material from the floor into the aperture 198 and down the chute 196.

The input conveyor 30 is conventional in its construction; and has a horizontal conveyor surface 202 at a prescribed level. The path of the input conveyor is a straight line. A deflector guide rail 203 is positioned above the conveyor surface 202, adjacent to the point where the straight-line path of the input conveyor intersects the circular path of the container pockets. The guide rail 203 directs the container to enter the pockets at a point where the velocity of the container pockets has a vector at a right angle to the direction of movement of the container. The output conveyor 32 includes a horizontal conveyor surface 204. The conveyor surface 204 is on the same plane as surface 202; and is positioned immediately below the lower end of the discharge section rail 154. The output conveyor also has a straight-line movement, which straight-line movement is tangential to the circular path of the measuring flasks.

In operation, the subject apparatus is adjusted for a can of a given size. The measuring flasks are selected for the can of a given size, and the quantity of material which is to be introduced into the container. Identical flasks are mounted on the tank floor. The empty containers are loaded onto the input conveyor 202, which carries the empty containers toward the filling turret. Inasmuch as the conveyors move in a straight line and are being carried toward the container pockets, the containers are driven into the appropriate container pockets. It is important to note that the arrangement of the input conveyor is such that, as the filling turret rotates, it tends to push a container into a container pocket at a right angle to the movement of the input conveyor. The velocity of the container in the container pocket (where the input conveyor intersects the circular path of the container pocket) is such that there is a vector at a right angle to the movement of the input conveyor. This arrangement causes the container to seat firmly in the container pocket, so that the container is immediately below its respective measuring flask.

The rotation of the filling turret causes the container to be carried to the container elevator 34. The container engages the endless belt 146, which raises the container upwardly, telescopically receiving its measuring flask. The container, with the flask, is then carried to the filling section rail 150, which section rail 150 is substantially flat. The container then slides along the rail, while the bottom of the measuring flask is adjacent to the bottom of the container. While the container is on the filling section rail 150, the measuring flask is filled with material.

The filling tank 74 is filled with a desired freeflowing powdered or granular material, which is a divided material, from a source which is not shown. Referring now to FIGS. 2 and 4, the granular or powdered material is delivered to the inlet tube 102, where the material drops down into the sleeve 104. The sleeve 104 is adjusted relative to the tank floor for a selected depth of material in the filling tank. The material is filled to a uniform level. It may be appreciated that, as the filling turret rotates (carrying with it floor 76), the material is also carried away from the inlet sleeve 104 but at a selected level. The material engages the vanes 106, 110 and 118, which vanes direct the material into the filler loop of the retainer. The material then drops into the measuring flasks. It may be appreciated that, as the material drops into the measuring flasks, the material engages the bottom of the respective container and builds up in the measuring flask until the flask is filled. As the filling turret continues to rotate, the measuring flasks then pass under the retainer, which scrapes off all of the additional material; and the flask is now completely filled by a given selected amount. It is important to note that the sleeve 104 may be used to adjust the depth of material in the filling tank, which in turn determines the amount of compaction of material in the measuring flask, thereby allowing an operator to make certain that the material is always of the proper amount.

Once the measuring flasks are moved past the retainer, the containers are carried to the filling section rail 152. The filling section rail 152 slopes downward from the section rail 150 to the discharge section rail 154. The downward sloping of the rail causes the container to drop away from the measuring flask, thereby allowing the material in the flask to be emptied into the container. The filling section rail 152 is vibrated both horizontally and vertically, so that the container is shaking to allow the material which is flowing into the can to shake down to eliminate voids and have a compacted filling of the container. The filled container then is delivered to the discharge section rail 154, which is slightly offset from the filling section rail 152, thereby tilting the containers toward the pocket. The container is then carried onto the output conveyor, which is tangential to the movement of the container. It may be appreciated that the discharge onto a tangential path reduces the possibility of tipping of the filled container. Furthermore, the container is held in its pocket for the maximum period of time.

As a material is delivered, it may be necessary to make a fine adjustment of the amount of material to be delivered to a container. The present construction allows a fine adjustment in that the filling section rail 151 may be raised or lowered to adjust the amount of space between the bottom of the measuring flask and the bottom of the container. When the measuring flask is being filled, it is possible to allow some material to be discharged into the container during the filling of the measuring flask to allow additional material to be introduced into the container.

FIGS. 9, 10 and 11 show how different size containers are used with different size measuring flasks. Also, FIGS. 10 and 11 show how the space between the bottom of the measuring flask and the bottom of the container may be adjusted to increase or decrease the volume of material which is introduced.

Although precautions are taken that containers be delivered to the filling apparatus, there are instances when a container may be bent or damaged, so that it does not feed properly into the apparatus. Then the measuring flask does not have a container under it as it is being filled, so that the material is simply passed through the measuring flask and is discharged onto the spill floor 190. The material is carried on the spill floor until it engages the scraper 200, which forces the material into the discharge chute 196, where it is collected.

Although a specific embodiment of the present invention has been described in detail above, it is readily apparent that those skilled in the art may make various modifications and changes without departing from the spirit and scope thereof. It is to be expressly understood that the instant invention is limited only by the appended claims.

What is claimed is:

1. An apparatus for filling like containers with a like measured amount of divided matter including; a housing; a drive connected to said housing; a filling turret in said housing having a rotatable portion connected to said drive and said portion being rotated by said drive at a prescribed rate, said filling turret including a filling tank having a rotatable base connected to said drive and said rotatable base rotated with said portion of the filling turret, a plurality of measuring flasks arranged in a circle concentric with the circle of rotation of said portion of the filling turret connected to said rotatable base of the filling tank for receiving divided matter therefrom and measuring the amount of said matter, said plurality of measuring flasks moving in a circular path having a center concentric with the center of the circle of the plurality of measuring flasks, and a container pocket positioned adjacent to each of the measuring flasks and moving therewith for carrying a container; an input conveyor positioned adjacent to the housing for delivering empty containers to the filling turret, said input conveyor moving in a straight-line path toward the filling turret intersecting the circular path of the container pockets at a point where the velocity of a container pocket at that point includes a vector at substantially a right angle to the direction of movement of a container on the input conveyor, said input conveyor urges the empty containers into the respective container pockets; a container elevator in said housing positioned adjacent to the point where the straight-line path of the input conveyor intersects the circular path of the container pockets for raising empty containers in the respective container pockets into a telescoping relationship with the respective measuring flasks; an arcuate container support in said housing positioned below a portion of the measuring flasks for holding the containers in telescoping relationship with the measuring flasks and then allowing the containers to move downward relative to the measuring flasks through a given portion of the circular path of the measuring flasks; and an output conveyor positioned adjacent to the container pocket path for receiving filled containers from the container pockets and carrying the filled containers away from the filling turret, said output conveyor having a straight-line path moving away from the filling turret and being substantially tangential to the circular path of the measuring flasks at the point of contact of the straight-line path and the circular path.

2. An apparatus for filling like containers with a like measured amount of divided matter as defined in claim 1, wherein the point of intersection of the straight-line path of the input conveyor with the circular path of the container pockets and the tangential contact point of the straight-line path of the output conveyor with the circular path of the container pockets are in the same quadrant of said circular path of the container pockets.

3. An apparatus for filling like containers with a like measured amount of divided matter as defined in claim 1, wherein the straight-line path of the input conveyor is parallel to the straight-line path of the output conveyor, and said input and output conveyors are adjacent to each other.

4. An apparatus for filling like containers with a like measured amount of divided matter as defined in claim 1 including, a spillage-recovery assembly mounted in said housing for collecting spilled divided matter.

5. An apparatus for filling like containers with a like measured amount of divided matter as defined in claim 1 including, a side band being substantially parallel to a portion of the arcuate container support for holding the containers in the respective container pockets, said side band being made of an elastic material.

6. An apparatus for filling like containers with a like measured amount of divided matter as defined in claim 1, wherein the filling tank includes an inlet sleeve supported by the housing substantially parallel to the axis of rotation of the rotatable base of the filling tank, said inlet sleeve having its upper end connected to a source of divided matter, and an adjustment sleeve telescopically connected to the lower end of the inlet sleeve for regulating the level of divided matter introduced into the filling tank.

7. An apparatus for filling like containers with a like measured amount of divided matter as defined in claim 1 including, a vibrator connected to a portion of the arcuate container support for vibrating the containers supported thereon to compact divided matter delivered into the containers from the respective measuring flasks.

8. An apparatus for filling like containers with a like measured amount of divided matter as defined in claim 1, wherein the filling tank includes an adjustment bar supported in the housing, and a divided matter vane pivotedly connected to the adjustment bar for being selectively positioned to direct divided matter toward the measuring flasks.

9. An apparatus for filling like containers with a like measured amount of divided matter as defined in claim 1, wherein the straight-line path of the input conveyor is parallel to the straight-line path of the output conveyor, said input and output conveyors are adjacent to each other, and the point of intersection of the straight-line path of the input conveyor with the circular path of the container pockets and the tangential contact point of the straight-line path of the output conveyor with the circular path of the container pockets are in the same quadrant of said circular path of the container pockets.

10. An apparatus for filling like containers with a like measured amount of divided matter as defined in claim 1 including; a floor connected to the rotatable portion of the filling turret extending outwardly therefrom and rotating therewith for receiving spilled divided matter; a discharge chute in said housing and extending downward below the level of the floor; and a diverter mounted in said housing adjacent to the discharge chute for moving spilled divided matter from the floor into the discharge chute.

11. An apparatus for filling like containers with a like measured amount of divided matter as defined in claim 1 including; a vibrator connected to a portion of the arcuate container support for vibrating the containers supported thereon to compact divided matter delivered into the containers from the respective measuring flasks; a side band being substantially parallel to a portion of the arcuate container support for holding the containers in the respective container pockets, said side band being made of an elastic material; and a spillage-recovery assembly mounted in said housing for collecting spilled divided matter.

12. An apparatus for filling like containers with a like measured amount of divided matter as defined in claim 1, wherein the filling tank includes; an inlet sleeve substantially parallel to the axis of rotation of the rotatable base of the filling tank, said inlet sleeve having its upper end connected to a source of divided matter, an adjustment sleeve telescopically connected to the lower end of the inlet sleeve for regulating the level of divided matter introduced into the filling tank, an adjustment bar mounted in the housing above the lower end of the adjustment sleeve, and a divided matter vane pivotedly connected to the adjustment bar for being selectively positioned to divert divided matter toward the measuring flasks 13. An apparatus for filling like containers with a like measured amount of divided matter as defined in claim 1 including, a side band positioned substantially parallel to a substantial portion of the arcuate container support for holding the containers in the respective container pockets, and a vibrator connected to the arcuate container support for vibrating containers supported thereon to compact divided matter delivered into the containers from the respective measuring flasks.

14. An apparatus for filling like containers with a like measured amount of divided matter as defined in claim 1 including; a spillage-recovery assembly mounted in said housing for collecting spilled divided matter; wherein the filling tank includes an adjustment bar supported on the housing, a vane pivotedly secured to the adjustment bar for being selectively positioned to direct divided matter toward the measuring flasks, an inlet sleeve mounted on the housing substantially parallel to the axis of rotation of the rotatable base of the filling tank, said inlet sleeve having its upper end connected to a source of divided matter, and an adjustment sleeve telescopically connected to the lower end of the inlet sleeve for regulating the level of divided matter introduced into the filling tank.

15. An apparatus for filling like containers with a like measured amount of divided matter as defined in claim 1 including; a vibrator connected to a portion of the arcuate container support for vibrating the containers supported thereon to compact divided matter into the containers; a side band being substantially parallel to a portion of the arcuate container support for holding the containers in the respective container pockets, said side band being made of an elastic material; a floor connected to the rotatable portion of the filling turret extending outwardly therefrom and rotating therewith for receiving spilled matter; a discharge chute mounted in said housing and extending downward below the level of the floor; and a diverter mounted in said housing adjacent to the chute for moving matter from the floor into the discharge chute; wherein the straight-line path of the input conveyor is parallel to the straight-line path of the output conveyor, said input and output conveyors are adjacent to each other, and the point of intersection of the straight-line path of the input conveyor with the circular path of the container pockets and the tangential contact point of the straight-line path of the output conveyor with the circular path of the container pockets are in the same quadrant of said circular path of the container pockets.

16. An apparatus for filling like containers with a like measured amount of divided matter as defined in claim 1 including; a vibrator connected to a portion of the arcuate container support for vibrating the containers supported thereon to compact divided matter delivered into the containers from the respective measuring flasks; and a spillage-recovery assembly mounted in said housing for collecting spilled divided matter; wherein the straight-line path of the input conveyor is parallel to the straight-line path of the output conveyor, the point of intersection of the straight-line path of the input conveyor with the circular path of the container pockets and the tangential contact point of the straight-line path of the output conveyor with the circular path of the container pockets are in the same quadrant of said circular path of the container pockets; and the filling tank includes, an adjustment bar mounted in the housing, a divided matter vane pivotedly connected to the adjustment bar for selectively positioning the vane to direct divided matter toward the measuring flasks, an inlet sleeve mounted in the housing substantially parallel to the axis of rotation of the rotatable base of the filling tank, said inlet sleeve having its upper end connected to a source of divided matter, and an adjustment sleeve telescopically connected to the lower end of the inlet sleeve for regulating the level of divided matter introduced into the filling tank.

17. An apparatus for filling like containers with a like measured amount of divided matter as defined in claim 1 including; a vibrator connected to a portion of the arcuate container support for vibrating containers supported thereon to compact divided matter delivered into the containers from the respective measuring flasks; a side band supported by the housing substantially parallel to a portion of the arcuate container support for holding containers in their respective container pockets, said side band being made of an elastic material; a floor connected to the rotatable portion of the filling turret extending outwardly therefrom and rotating therewith for receiving spilled divided matter; a discharge chute in said housing and extending downward below the level of the floor; and a diverter mounted in said housing adjacent to the discharge chute for moving divided matter from the floor into the discharge chute; wherein the point of intersection of the straight-line path of the input conveyor with the circular path of the container pockets and the tangential contact point of the straight-line path of the output conveyor with the circular path of the container pockets are in the same quadrant of said circular path of the container pockets, the straight-line path of the input conveyor is parallel to the straight-line path of the output conveyor, said input and output conveyors are adjacent to each other; and the filling tank includes, an inlet sleeve mounted on the housing substantially parallel to the axis of rotation of said rotatable base of the filling tank, said inlet sleeve having its upper end connected to a source of divided matter, an adjustment sleeve telescopically connected to the lower end of the inlet sleeve for regulating the level of divided matter introduced into the filling tank, an adjustment bar supported by the housing, and a divided matter vane pivotedly releasably secured to the adjustment bar for being selectively positioned to direct divided matter from the adjustment sleeve toward the measuring flasks.

18. An apparatus for filling like containers with a like measured amount of divided matter including; a housing; a drive connected to said housing; a filling turret in said housing having a rotatable portion connected to said drive rotated at a prescribed rate, said filling turret including a filling tank connected to said drive and having a rotatable base rotated with the filling turret, a plurality of measuring flasks arranged in a circle concentric with the circle of rotation of the filling turret connected to said rotatable base of the filling tank for receiving divided matter from the filling tank and measuring the amount of said matter, said plurality of measuring flasks moving in a circular path having its center concentric with the circle of the plurality of measuring flasks, and a container pocket positioned adjacent to each of the measuring flasks and moving therewith for receiving and moving a container; an arcuate container support mounted in said housing and positioned below a portion of the measuring flasks for holding the containers in telescoping relationship with said measuring flasks at a selected height relative to the respective measuring flasks and then allowing the containers to move downward relative to the respective measuring flasks through a given portion of the circular path of the measuring flasks; a floor connected to the rotatable portion of the filling turret extending outwardly therefrom and rotating therewith for receiving spilled divided matter; a discharge chute in said housing and extending downward below the level of the floor; and a diverter mounted in said housing adjacent to the discharge chute for moving matter from the floor into the discharge chute.

19. An apparatus for filling like containers with a like measured amount of divided matter as defined in claim 18, wherein the filling tank includes, an adjustment bar mounted in the housing above the level of divided matter in the tank, a divided matter vane pivotedly connected to the adjustment bar for being selectively positioned to direct divided matter toward the measuring flasks, an inlet sleeve mounted in the housing substantially parallel to the axis of rotation of the rotatable base of the filling tank, said inlet sleeve having its upper end connected to a source of divided matter, and an adjustment sleeve telescopically connected to the lower end of the inlet sleeve for regulating the level of divided matter introduced into the filling tank.

20. An apparatus for filling like containers with a like measured amount of divided matter as defined in claim 18, wherein the filling tank includes, an inlet sleeve mounted in the housing substantially parallel to the axis of rotation of the rotatable base of the filling tank, said inlet sleeve having its upper end connected to a source of divided matter, an adjustment sleeve telescopically connected to the lower end of the inlet sleeve for regulating the level of divided matter introduced into the filling tank, an adjustment bar mounted on the housing, and a divided matter vane pivotedly connected to the adjustment bar for being selectively positioned to direct divided matter toward the measuring flasks; and including a side band being substantially parallel to a portion of the arcuate container support for holding the containers in the respective container pockets, and a vibrator connected to the arcuate container support for vibrating the containers supported thereon to compact divided matter delivered into the containers from the respective measuring flasks.

* * * * *